US005924849A

United States Patent [19]

Kirchgessner et al.

[11] Patent Number: 5,924,849

[45] Date of Patent: Jul. 20, 1999

[54] HOLDING DEVICE FOR ELECTRIC FANS IN PARTICULAR MINIFANS

[75] Inventors: Hilmar Kirchgessner, VS-Villingen; Arno Wolfgang Winkler, St. Georgen, both of Germany

[73] Assignee: Trystart Industrial Limited, The Hong Kong Special Administrative Region of the People's Republic of China

[21] Appl. No.: 08/903,863

[22] Filed: Jul. 31, 1997

[30] Foreign Application Priority Data

Jul. 31, 1996 [DE] Germany ..... 296 13 278 U

[51] Int. Cl.[6] ..... F04B 41/00

[52] U.S. Cl. ..... 417/423.15; 415/126; 415/214.1

[58] Field of Search ..... 417/423.15; 415/126, 415/214.1

[56] References Cited

U.S. PATENT DOCUMENTS 2,594,688 4/1952 Shapiro ..... 183/37

3,506,226 4/1970 Blomgren ..... 248/15

5,707,205 1/1998 Otsuka ..... 415/119

*Primary Examiner*—Charles G. Freay

*Assistant Examiner*—Ehud Gartenberg

*Attorney, Agent, or Firm*—Jones & Askew, LLP

[57] ABSTRACT

The present invention pertains to a holding device (4) for holding an electric fan (1), in particular, a minifan, on a mounting wall (2). The invention is characterized by at least one essentially flat holding part (10), one side of which defines a fan contact plane (12), wherein said holding part comprises at least one plug element (14) that projects from the holding part (10) approximately perpendicular to the contact plane (12) and can be positively and/or nonpositively inserted into a mounting hole (16) of the fan (1) as well as at least one pin-like fastening element (22) that projects from the holding part (10) approximately perpendicular to the plug element (14) and can be inserted into a hole (20) in the mounting wall (2).

16 Claims, 4 Drawing Sheets

Figure 1:
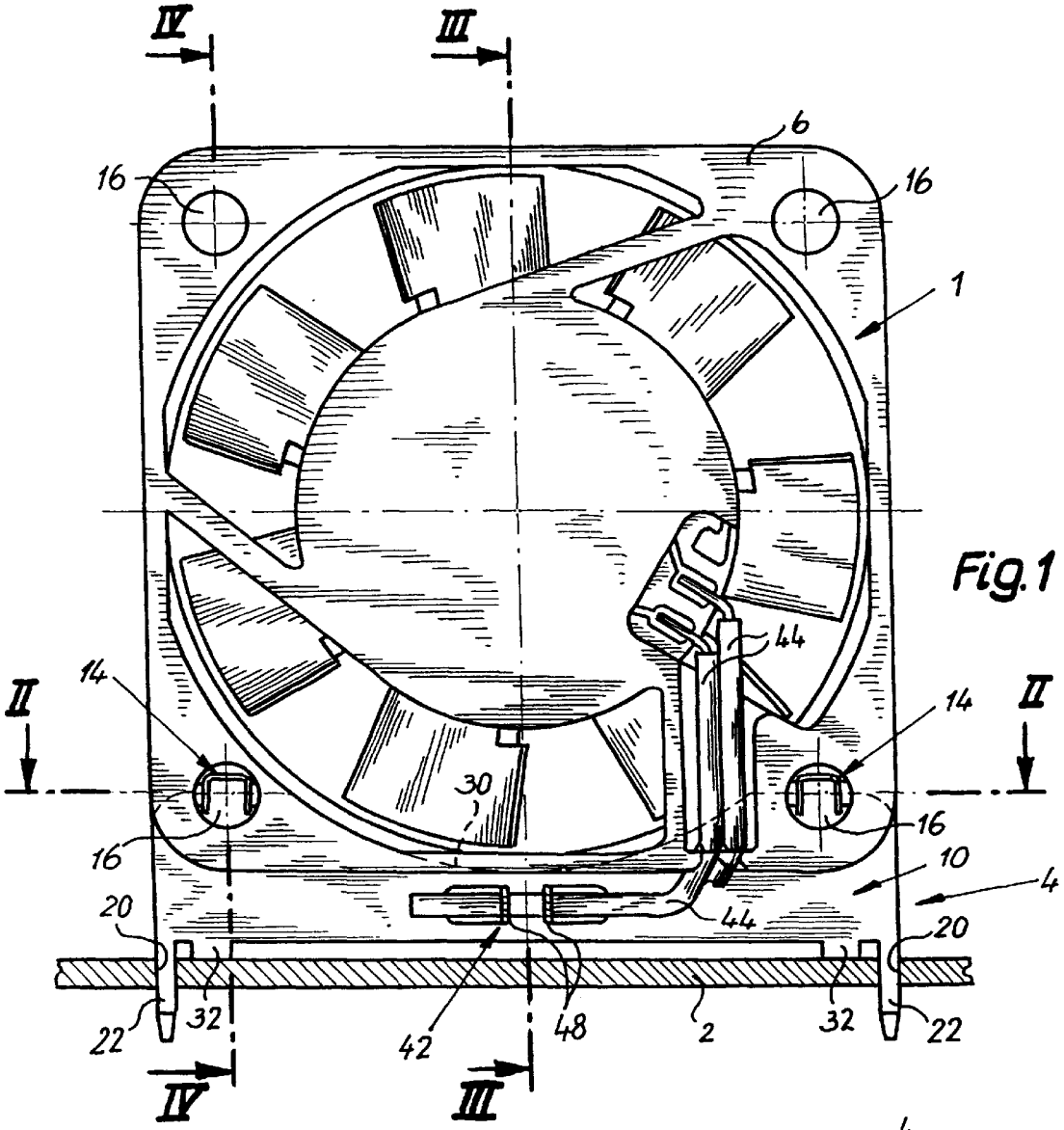

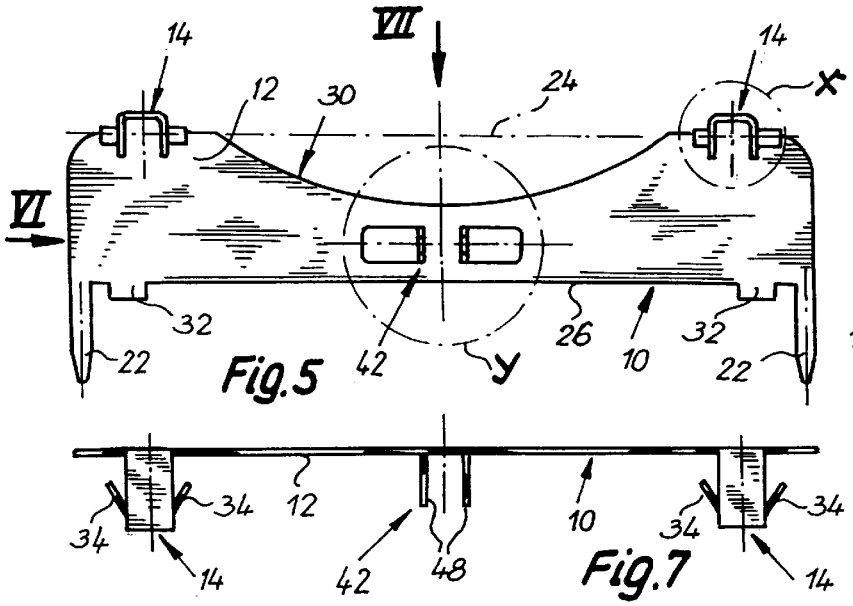
Fig.5
Fig.7
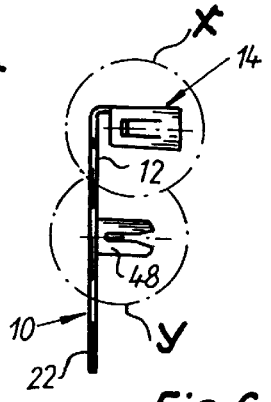
Fig.6
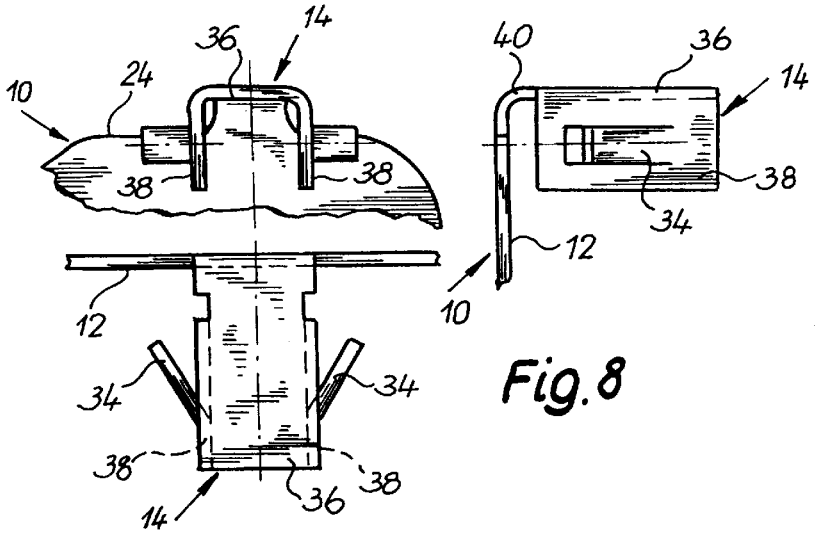
Fig.8
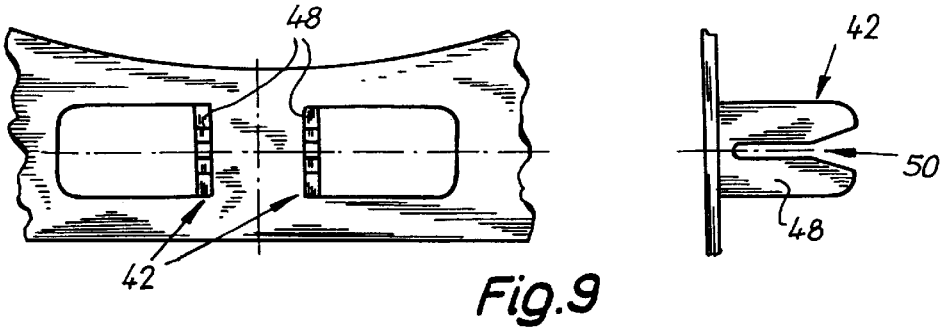
Fig.9

HOLDING DEVICE FOR ELECTRIC FANS IN PARTICULAR MINIFANS

The present invention pertains to a holding device for holding an electric fan, in particular, a minifan, on a mounting wall.

Fans or fan housings of the type discussed in connection with the present invention comprise at least two, usually four, continuous mounting holes that extend parallel to the fan axis. The fan housing frequently has a rectangular or square contour-as seen in an axial section. In this case, a continuous mounting hole is arranged in each corner region. It is known to utilize angular brackets for mounting the fans. One respective limb of the angular brackets is fastened to the fan by means of screws, with the other limb of the angular bracket usually being screwed to the mounting wall. Nuts, or so-called plate nuts, into which the respective fastening screws engage, are arranged on the fan housing for fastening the fan to the mounting wall.

DE 37 31 574 A1 discloses a fastening element in the form of a U-shaped bracket. This bracket comprises two limbs that are respectively provided with a threaded opening that acts as an internal thread (nut). This fastening element is only used for fans, the housings of which comprise two flanges that are spaced apart at least within the region of the mounting holes. In this case, each mounting hole practically consists of two aligned partial holes of the flanges. The U-shaped bracket is inserted between the flanges in such a way that one of the two threaded openings is arranged within the region of each partial hole. The bracket is realized elastically such that it is clamped between the flanges.

The present invention is based on the objective of developing a holding device that significantly simplifies the mounting of a fan.

According to the invention, this objective is attained with a holding device that consists of at least one essentially flat holding part that defines a fan contact plane on one side. In this case, the holding element comprises at least one plug element that projects from the holding part approximately perpendicular to the contact plane and can be inserted into a mounting hole of the fan as well as at least one pin-like fastening element that projects from the holding part approximately perpendicular to the plug element and can be inserted into a hole in the mounting wall.

Due to the invention, any screw connection is advantageously eliminated because the holding part according to the invention is simply inserted into the respective mounting hole with its plug element. Consequently, the invention is also suitable for fans with continuous mounting holes. A superior positive and/or nonpositive connection can be attained by a suitable design of the plug element. In this respect, it is advantageous if the plug element comprise barb-like, elastic holding tabs that when inserted into the mounting hole engage with the wall of the mounting hole in such a way that subsequent removal is nearly impossible. A superior and secure retention of these holding tabs in the wall of the mounting hole is, in particular, attained with fan housings that consist of plastic. However, the invention is, in principle, also suitable for metal housings. In both instances, it is advantageous if the holding part according to the invention consist of metal, preferably sheet metal.

In order to mount the fan on the mounting wall, it is merely required to insert the pin-like or (flat) plug-like fastening element into a hole in the mounting wall and subsequently fix the fastening element in suitable fashion. This may be simply realized by means of a plastic deformation, e.g., by bending and/or deforming the fastening element on the side of the mounting wall situated opposite to the fan. In this case, a positive connection is attained. However, it is also possible to integrally connect the fastening element to the mounting wall, in particular, by means of soldering or bonding.

According to one advantageous embodiment of the invention, the holding device consists of two—in particular, identical—holding parts that are fastened to both face sides of the fan housing by means of preferably two plug elements. Each holding element preferably comprises two fastening elements for mounting the holding element to the mounting wall. Consequently, a total of four fastening elements that can be inserted into corresponding holes in the mounting wall are provided. This embodiment results in a very secure and rigid mounting.

In another embodiment of the invention, the holding parts serve—in addition to fulfilling their mechanical holding function—for producing the electrical connection with the fan. In this case, both holding parts consist of an electrically conductive material, in particular, sheet metal. The fan housing consists of an electrically insulating material (plastic) so as to prevent a short circuit between the live holding parts. The electrical connection is preferably realized directly with a printed-circuit board that acts as the mounting wall. In this case, the inserted fastening elements of the holding parts are soldered to corresponding strip conductors. This may be simply realized with a solder bath, if possible, simultaneously with the soldering of additional electronic components. It is then merely required to electrically connect the fan to the holding part. For this purpose, each holding part preferably comprises at least one electric connecting element, to which the supply conductor (pigtail lead) of the fan can be connected. This embodiment significantly simplifies the electrical connection of the fan. The supply conductors can already be connected to their connecting elements after the two holding parts are attached. The electrical connection is then produced simultaneously with the mechanical connection between the holding parts and the printed-circuit board in only one production step. This results in a significantly simpler mounting of the fan, i.e., its mechanical mounting and electrical connection. According to the invention, the fan and the holding part form a preassembled unit that—analogously to other (electronic) components—can be very easily handled during the assembly of the printed-circuit board.

Additional advantageous characteristics of the invention are disclosed in the following description.

Figure 2:
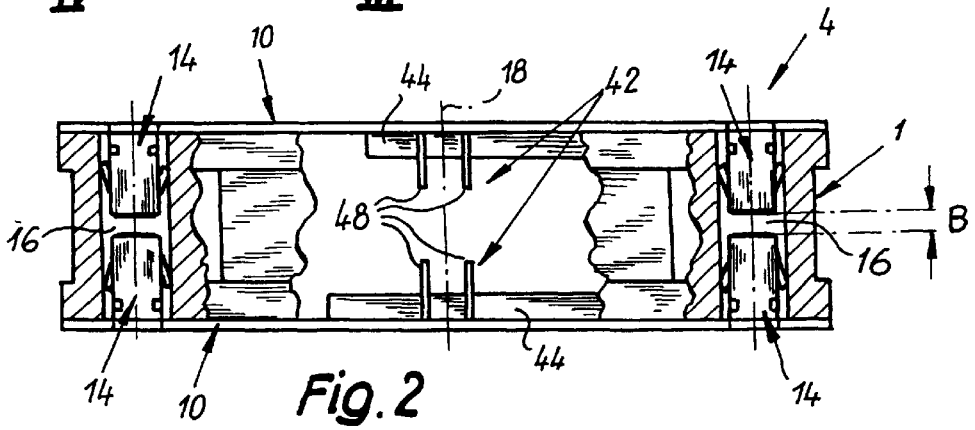
Figure 3:
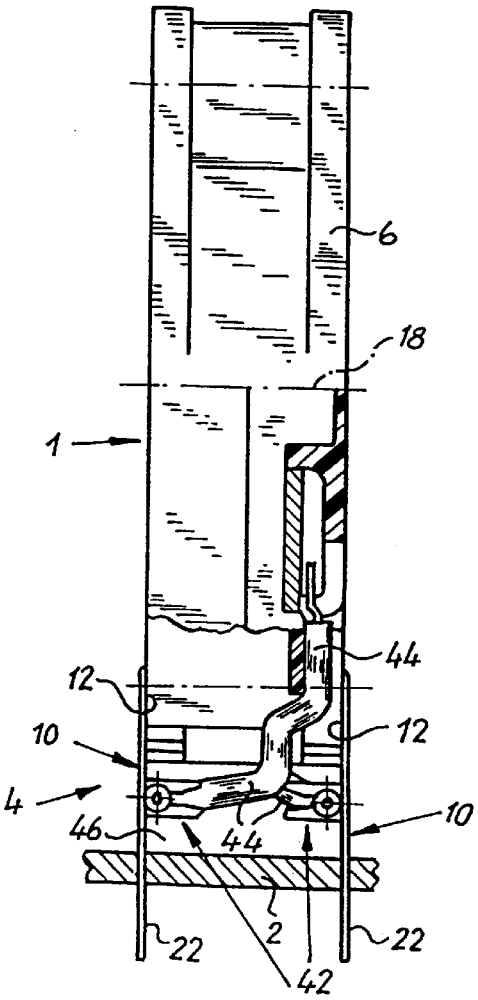
Figure 4:
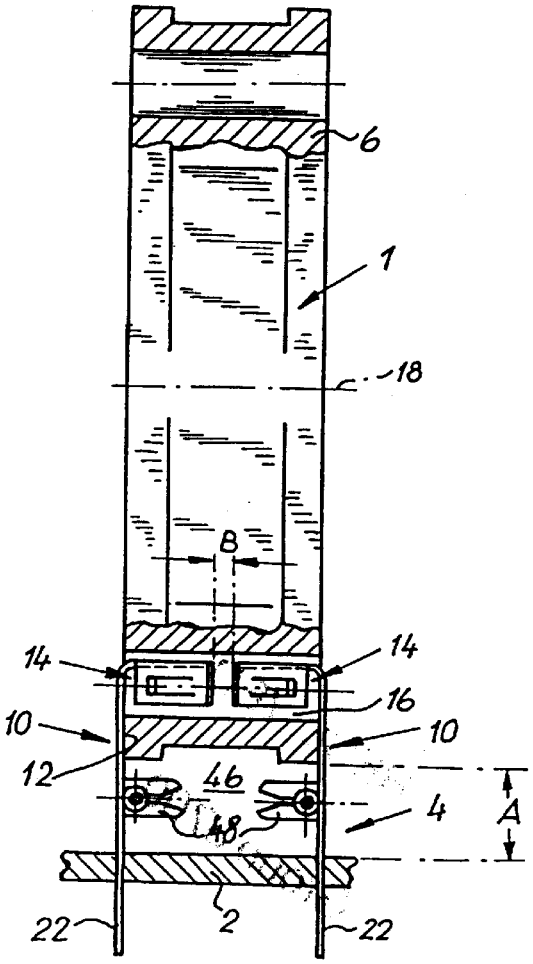
Figure 4A:
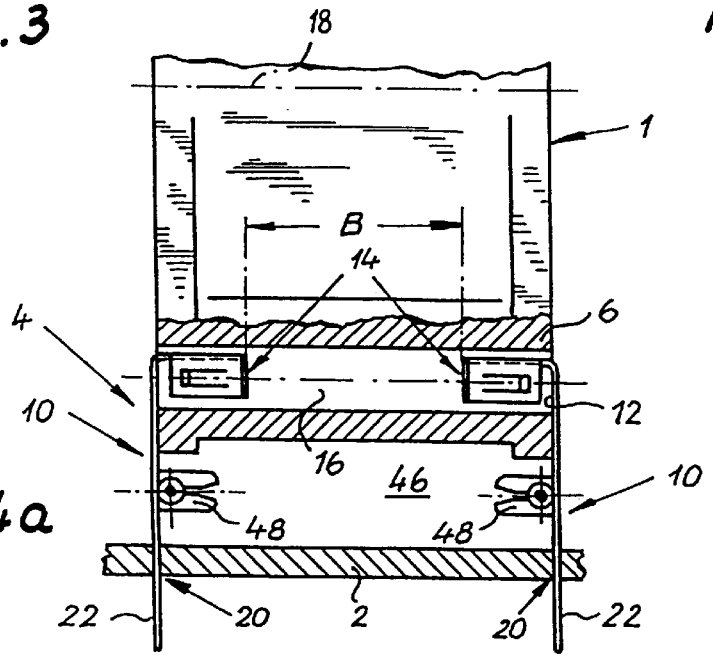
Figure 10:
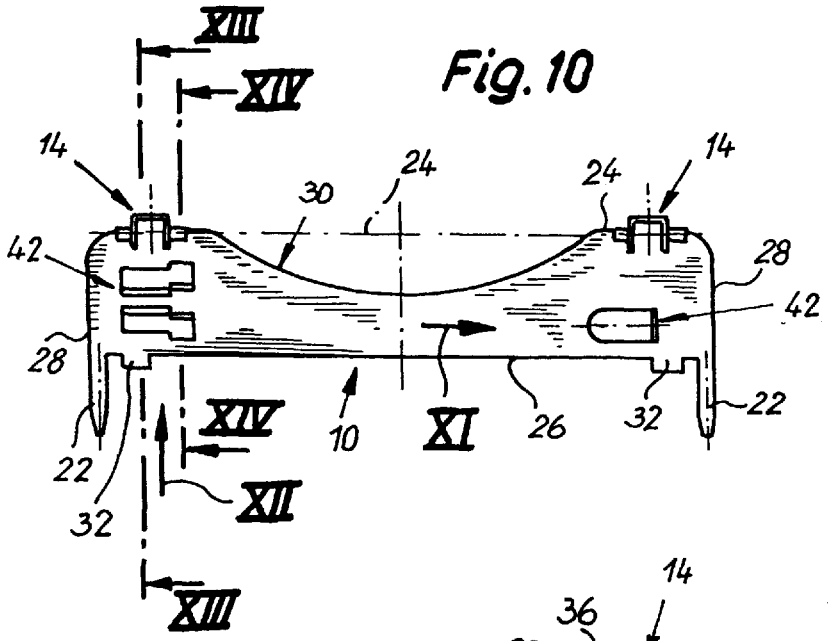
Figure 11:
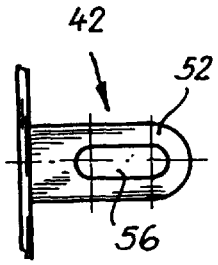
Figure 12:
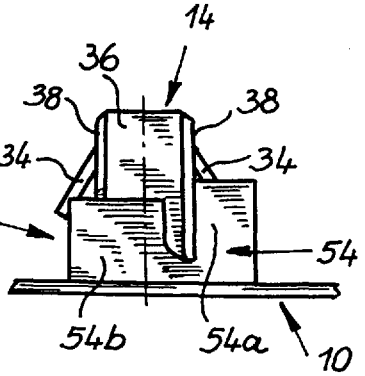
Figure 13:
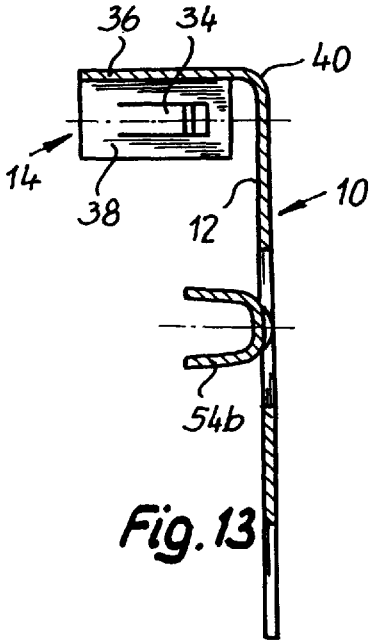

The invention is described in detail below with reference to the preferred embodiments illustrated in the figures. Shown are:

FIG. 1, a front view in partial cross section of a fan that is held on a mounting wall with the holding device according to the invention;

FIG. 2, a partial section along plane II—II in FIG. 1;

FIG. 3, a partial section along line III—III in FIG. 1;

FIG. 4, a corresponding partial section along plane IV—IV in FIG. 1;

FIG. 4*a,* a partial illustration according to FIG. 4 of one embodiment;

FIG. 5, a front view of a holding part according to the invention;

FIG. 6, a side view in the direction of arrow VI in FIG. 5;

FIG. 7, a top view in the direction of arrow VII in FIG. 5;

FIG. 8, a front view, a side view and a top view of detail X in FIGS. 5 and 6, respectively, in the form of a highly enlarged representation;

FIG. 9, a front view and a side view of detail Y in FIGS. 5 and 6, respectively, in the form of a highly enlarged representation;

FIG. 10, a front view of the holding part analogous to FIG. 5, however, in the form of an alternative embodiment;

FIG. 11, an enlarged partial side view in the direction of arrow XI in FIG. 10;

FIG. 12, an enlarged partial view in the direction of arrow XII in FIG. 10;

FIG. 13, an enlarged section along line XIII—XIII in FIG. 10, and

Figure 14:
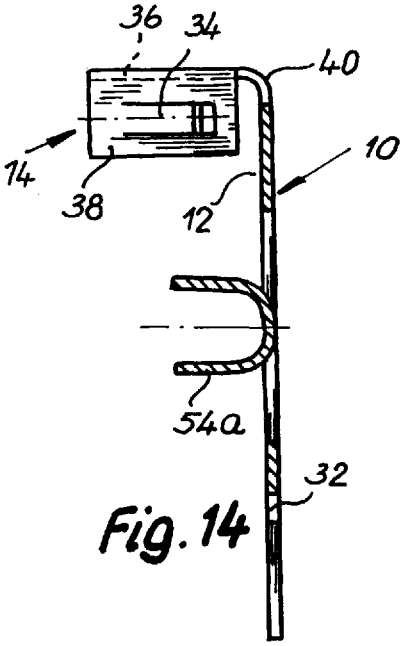

FIG. 14, a section along line XIV—XIV in FIG. 10.

In all figures, identical components are identified by the same reference numerals; moreover, these components are usually only described once.

FIG. 1 shows a holding device 4 according to the invention which serves for fastening the fan 1 to a mounting wall 2. The fan 1 that is illustrated in highly enlarged fashion in FIG. 1 is a minifan, the fan housing 6 of which has a square contour, for example, approximately 40×40 mm. However, the invention is not limited to fans of this type. The holding device may be used for axial fans—as shown—or radial fans.

In the preferred embodiment shown, the holding device 4 consists of two preferably identical holding parts 10. Each holding part 10 is realized essentially flat and defines a fan contact plane 12 on one side with part of its surface. Within this region, the holding part 10 preferably comprises two plug elements 14 that project approximately perpendicular to the contact plane 12 and can be positively and/or non-positively inserted into a respective mounting hole 16 of the fan 1 or the fan housing 6. Each mounting hole 16 extends parallel to the fan axis 18, i.e., this also applies correspondingly to the plug elements 14. Consequently, the holding parts 10 lie in parallel planes that extend perpendicular to the fan axis 18 and the mounting wall 2. According to FIGS. 2, 4 and 4*a*, the plug elements 14 of both holding parts 10 respectively extend into the mounting holes 16 from opposing face sides of the fan 1.

In addition, each holding part 10 also comprises two preferably pin-like fastening elements 22 that are aligned approximately perpendicular to the plug elements 14. These fastening elements that project from the holding part 10 and point away from the aforementioned plug elements can be respectively inserted into one hole 20 of the mounting wall 2.

Due to the previously described design, the fan 1 can be fastened to the mounting wall 2 with the holding device 4 according to the invention in such a way that its fan axis 18 extends parallel to the plane of the mounting wall 2.

FIGS. 5–9 and FIGS. 10–14 show that each holding part 10 is preferably realized in the form of a one-piece punched and bent sheet metal part. Consequently, the holding parts can be manufactured very inexpensively in only one punching/bending process. This is particularly advantageous with respect to the fact that fans of this type, and consequently also the holding parts 10, represent mass articles.

According to FIGS. 5 and 10, the holding part 10 has an oblong, essentially rectangular surface shape. In this case, the plug elements 14 are arranged on the upper longitudinal edge 24, with the fastening elements being arranged on the lower longitudinal edge 26, in particular, in the corner regions that border the narrow sides 28. A center-symmetric recess 30 that has the shape of a circular arc and serves for the adaptation to the fan flow region may—as shown—be arranged within the region of the upper longitudinal edge 24 (see FIG. 1).

FIGS. 5 and 10 also show that the holding part 10 comprises at least one, preferably two support elements 32 on its lower longitudinal edge 26 adjacent to the fastening elements 22. These support elements 32 are, after inserting the fastening elements 22 into the holes 20 of the mounting wall 2, supported on the mounting wall 2; consequently, they practically form support legs (see FIG. 1).

The enlarged representation according to FIG. 8 shows most clearly that each plug element 14 compresses two elastic, barb-like holding tabs 34 that engage with the wall of the mounting hole 16 after the plug elements 14 are inserted into the respective mounting hole 16 of the fan 1. If the holding part 10 is realized in the form of a punched and bent part, each plug element has a U-shaped cross section with one upper U-wall 36 and two lateral U-walls 38. In this case, the holding tabs 34 are punched out of the two lateral walls 38 and bent transversely upward and subsequently back in the direction of the contact plane 12. The wall 36 is integrally connected to the upper longitudinal edge 24 of the plane section of the holding part 10 by means of a bent connecting section 40.

According to FIGS. 1, 5 and 10, each fastening element 22 is preferably realized in the form of a punched, narrow material strip, with this material strip preferably lying in the plane of the holding part 10.

According to one preferred embodiment of the invention, the holding parts 10 also serve for producing the electrical connection with the fan 1. In this case, an electrically conductive connection between the holding parts 10 and the strip conductors of a printed-circuit board that forms the mounting wall 2 is realized by means of the fastening elements 22. These fastening elements are, after being inserted into the holes 20, soldered to the strip conductors. In addition, each holding part 10 comprises at least one connecting element 42 that serves for producing an electrical connection with a supply conductor 44 of the fan 1 (see FIG. 3). In this case, each connecting element 42 is arranged within a surface region of the holding part 10 which in the mounted condition—see, in particular, FIG. 4—defines a distance A and consequently a free space 46 between the fan 1, the mounting wall 2 and the two opposing holding parts 10. Each connecting element 42 is preferably formed of the material of the holding part 10, in particular, by punching and bending, and extends into the free space 46 from the fan contact side.

In the embodiment according to FIGS. 1–9, the holding part 10 as the connection element 42 is provided with at least one clamping/cutting connector 48. However, it is preferred that the holding part comprises two parallel clamping/cutting connectors 48 that are separated. The arrangement of two clamping/cutting connectors 48 is advantageous with respect to the fact that a conductor can be simultaneously inserted into both clamping/cutting connectors 48 such that a superior electrical contact (high contact safety) as well as a superior positional and directional fastening of the conductor 44 is attained. FIG. 9 shows that each clamping/cutting connector 48 comprises a conventional tapered insertion slot 50 for the conductor 44. When inserting the conductor perpendicular to its longitudinal extent, its installation is cut open such that a metallic contact with the conductor is realized without having to remove the insulation.

In the embodiment shown in FIGS. 10–14, the holding part is provided with a connecting element 42 in the form of a soldering lug or soldering terminal 52 on one end and a crimp connector 54 on the other end. According to FIG. 11, the soldering lug 52 is punched out of the holding part 10 and bent by 90°. This soldering lug comprises, in particular, an oblong hole 56 for inserting the conductor 44. According to FIG. 12, the crimp connector 54 consists of a holding section 54*a* for the insulation of the conductor 44 as well as a contact section 54*b* for the stripped end of the conductor 44.

The embodiments by way of example of the connecting elements 42 described above can be utilized in arbitrary combinations and numbers. In this case, the user is able to select a suitable type of connection.

According to FIGS. 2, 4 and 4*a*, it is essential, with respect to the electrical connection of the fan 1, that the respective pairs of plug elements 14 that are inserted into the same mounting hole 16 such that they oppose one another be spaced apart by a distance B. This distance B must be at least large enough to ensure sufficient electric insulation between the plug elements 14 at different potentials. For this purpose, each plug element 14 has an insertion length that, measured from the fan contact plane 12, is significantly less than half of the total length of the respective mounting hole 16.

Depending on the design of the motor that drives the fan 1, the holding parts 10 according to the invention may also serve for connecting the motor windings.

The invention is not limited to the embodiments shown and described, but rather also includes all embodiments that function identically in the sense of the invention.

In addition, the invention is not limited to the combination of characteristics defined in claim 1, but may also be defined by any arbitrary combination of certain individual characteristics disclosed. This means that practically any individual characteristic of claim 1 may be omitted or replaced with at least one individual characteristic disclosed at another point of the application. In this respect, claim 1 solely represents a first attempt to formulate the invention.

We claim:

1. Holding device (4) for holding an electric fan (1), in particular, a minifan, on a mounting wall (2), characterized by at least one essentially flat holding part (10), one side of which defines a fan contact plane (12), wherein said holding part comprises at least one plug element (14) that projects from the holding part (10) approximately perpendicular to the contact plane (12) and is inserted into a mounting hole (16) of the fan (1) as well as at least one pin-like fastening element (22) that projects from the holding part (10) approximately perpendicular to the plug element (14) and is inserted into a hole (20) in the mounting wall (2).

2. Holding device according to claim 1, characterized by the fact that the holding part (10) is realized in the form of a one-piece punched and bent sheet metal part.

3. Holding device according to claim 1, characterized by the fact that the holding part (10) comprises two plug elements (14) that extend parallel with respect to their plug axes and are arranged at a distance from one another which corresponds to the specific hole spacing between two mounting holes (16) of the respective fan (1).

4. Holding device according to claim 1, characterized by the fact that the holding part (10) comprises two parallel fastening elements (22) that are spaced apart from one another.

5. Holding device according to claim 3, characterized by the fact that the holding part (10) has an oblong, essentially rectangular surface shape, wherein the plug elements (14) are arranged on one longitudinal edge (24) and two parallel fastening elements (22) that are spaced apart from one another are arranged on the other, opposite longitudinal edge (26), in particular, in the lateral regions that border the narrow sides (28).

6. Holding device according to claim 1, characterized by the fact that the or each fastening element (22) is, after being inserted into the hole (20), subjected to a plastic deformation and/or integrally fastened, in particular, soldered, in order to connect the fastening element(s) to the mounting wall (2).

7. Holding device according to claim 1, characterized by the fact that the or each plug element (14) comprises at least one, preferably two elastic, barb-like holding tabs (34) that engage with the wall of the mounting hole (16) of the fan (1).

8. Holding device according to claim 1, characterized by the fact that the or each fastening element (22) is realized in the form of a narrow, punched material strip that lies in the plane of the holding part (10).

9. Holding device according to claim 1, characterized by the fact that the holding part (10) consists of an electrically conductive material and comprises at least one connecting element (42) for producing an electrical connection with the supply conductor (44) of the fan (1).

10. Holding device according to claim 1, characterized by the fact that the holding part (10) comprises at least one clamping/cutting connector (48) and/or at least one soldering lug (52) and/or at least one crimp connector (54) as the connecting element (42).

11. Holding device according to claim 9 or 10, characterized by the fact that the or each connecting element (42) is arranged within a surface region of the holding part (10) which in the mounted condition defines a distance (A) between the fan (1) and the mounting wall (2).

12. Holding device according to claim 9, characterized by the fact that the or each connecting element (42) is realized in the form of a one-piece element that consists of the material of the holding part (10) and preferably extends away from the fan contact side.

13. Holding device according to claim 1, characterized by the fact that two—in particular, identical—holding parts (10) are arranged on opposite face sides of the fan (1).

14. Holding device according to claim 13, characterized by the fact that the two holding parts (10) can be electrically connected to the strip conductors of a printed-circuit board that forms the mounting wall (2) by means of their fastening elements (22).

15. Holding device according to claim 13, characterized by the fact that the plug elements (14) of the two holding parts (10)—which are preferably inserted into the same mounting hole (16) of the fan (1) in the form of a pair such that they oppose one another—have an insertion length that, measured from the fan contact plan (12), is smaller than half the total length of the respective mounting hole (16).

16. Fan (1), in particular, an electric minifan for cooling electronic components, with a fan housing (6) that comprises mounting holes (16) that extend approximately parallel to the fan axis (18) and, in particular, consists of plastic, characterized by a holding device (4) according to claim 1.

* * * * *

UNITED STATES PATENT AND TRADEMARK OFFICE

CERTIFICATE OF CORRECTION

PATENT NO. : 5,924,849

DATED : July 20, 1999

INVENTOR(S) : Hilmar Kirchgessner, et al.

It is certified that error appears in the above-identified patent and that said Letters Patent is hereby corrected as shown below:

Change the name of the Assignee (INID Code 73) to read, in its entirety --Papst-Motoren GmbH & Co. KG , Georgen, Germany--.

Signed and Sealed this

Twenty-first Day of March, 2000

*Attest:*

*Attesting Officer*

Q. TODD DICKINSON

*Commissioner of Patents and Trademarks*